US005479241A

United States Patent [19]

Hou et al.

[11] Patent Number: 5,479,241

[45] Date of Patent: Dec. 26, 1995

[54] METHOD AND APPARATUS FOR DETERMINING AND UPDATING A PHOTORECEPTOR BELT STEERING COEFFICIENT IN A BELT TRACKING SYSTEM

[75] Inventors: Ssujan Hou, Webster; Jacob N. Kluger, Rochester, both of N.Y.

[73] Assignee: Xerox Corporation, Stamford, Conn.

[21] Appl. No.: 6,347

[22] Filed: Jan. 19, 1993

[51] Int. Cl.[6] ..... G03G 21/00

[52] U.S. Cl. ..... 355/212; 198/807; 226/21; 346/134; 346/136

[58] Field of Search ..... 226/21, 22, 23, 226/18; 355/212, 210; 198/804–810, 502.4; 346/134, 136

[56] References Cited

U.S. PATENT DOCUMENTS

| | | | |
|---|---|---|---|
| 3,592,071 | 7/1971 | Steinke | 74/241 |
| 3,820,888 | 6/1974 | Jordon . | |
| 3,913,729 | 10/1975 | Andrews | 198/807 |
| 3,963,068 | 6/1976 | Hazelett et al. | 164/278 |
| 4,027,966 | 6/1977 | Jordan . | |
| 4,069,959 | 1/1978 | Bartell et al. | 226/21 |
| 4,170,175 | 10/1979 | Conlon, Jr. | 101/1 |
| 4,174,171 | 11/1979 | Hamaker et al. . | |
| 4,177,609 | 12/1979 | Rameckers et al. | 51/170 EB |
| 4,189,223 | 2/1980 | Silverberg . | |
| 4,200,211 | 4/1980 | Yamagishi et al. | 226/21 |
| 4,286,706 | 9/1981 | Castelli et al. | 198/806 |
| 4,291,825 | 9/1981 | Glanz | 226/18 |
| 4,337,598 | 7/1982 | Barth et al. | 198/805 X |
| 4,344,693 | 8/1982 | Hamaker . | |
| 4,485,982 | 12/1984 | St. John et al. . | |
| 4,527,686 | 7/1985 | Satoh | 198/807 |
| 4,629,061 | 12/1986 | Crandall | 198/807 |
| 4,959,040 | 9/1990 | Gardner et al. . | |
| 4,961,089 | 10/1990 | Jamzadeh | 355/207 |
| 5,011,060 | 4/1991 | Cramer | 226/15 |
| 5,077,576 | 12/1991 | Stansfield et al. | 355/212 |
| 5,096,044 | 3/1992 | Biebel | 198/502.4 |
| 5,197,366 | 3/1993 | Paulson et al. | 83/498 |
| 5,225,877 | 7/1993 | Wong | 355/212 |
| 5,248,027 | 9/1993 | Kluger et al. . | |
| 5,284,088 | 2/1994 | Fantoni et al. | 101/228 |
| 5,302,037 | 4/1994 | Schoendienst et al. | 400/586 |

FOREIGN PATENT DOCUMENTS

| | | |
|---|---|---|
| 0421164A1 | 9/1990 | European Pat. Off. . |

*Primary Examiner*—A. T. Grimley
*Assistant Examiner*—T. A. Dang
*Attorney, Agent, or Firm*—Fay, Sharpe, Beall, Fagan, Minnich & McKee

[57] ABSTRACT

An electrophotographic printing machine is provided having an endless photoreceptor belt arranged to move in a predetermined path through a plurality of processing stations. The apparatus is used in conjunction with a method for automatically and repeatedly measuring and updating a steering coefficient used in an automatic steering mode. The method includes centering the belt and finding the average "in" belt walk and "in" belt walk rate and the average "out" belt walk and "out" belt walk rate, in order to determine the steering control coefficient. The method allows for a single machine to have its steering coefficient repeatedly updated.

23 Claims, 8 Drawing Sheets

METHOD AND APPARATUS FOR DETERMINING AND UPDATING A PHOTORECEPTOR BELT STEERING COEFFICIENT IN A BELT TRACKING SYSTEM

BACKGROUND OF THE INVENTION

This invention relates generally to an electrophotographic printing machine, and more particularly concerns an improved method and apparatus for controlling the lateral movement of a moving belt.

In the process of electrophotographic printing, a photoreceptor belt is charged to a substantially uniform potential so as to sensitize the surface thereof. The charged portion of the belt is exposed to a light image of an original document being reproduced. Exposure of the charged belt selectively discharges the charge thereon in the irradiated areas. This records an electrostatic latent image on the belt corresponding to the informational areas contained within the original document. After the electrostatic latent image is recorded on the belt, the latent image is developed by bringing a developer mixture into contact therewith. Generally, the developer mixture comprises toner particles adhering triboelectrically to the carrier granules. The toner particles are attracted from the carrier granules to the latent image forming a toner powder image on the photoreceptor belt. The toner powder image is then transferred from the belt to a copy sheet. Finally, the copy sheet is heated to permanently affix the toner particles thereto in image configuration. This general approach was originally disclosed by Carlson in U.S. Pat. No. 2,297,691 and has been further amplified and described by many related patents in the art.

Since the belt passes through many processing stations during the printing operation, lateral alignment thereof is critical and must be controlled within prescribed tolerances. As the belt passes through each of these processing stations, the location of the latent image must be precisely defined in order to optimize the operations relative to one another. If the position of the latent image deviates from processing station to processing station, copy quality may be significantly degraded. Hence, lateral movement of the photoreceptor belt must be minimized so that the belt moves in a predetermined path.

Similarly, document handling systems frequently employ belts to transport original documents to and from the exposure station. The lateral movement of belts used in document handling systems must also be controlled in order to insure the correct positioning of the original documents relative to the optical system of the exposure station.

There is a special need for precise control of a belt's lateral movement in a machine designed for multichromatic (color copy) image reproduction. In making multichromatic reproductions with an apparatus utilizing, for example, a moving charged photoreceptor belt, charge patterns corresponding to related color separation images may be formed in successive image frames of the belt. Such patterns are developed with pigmented marking particles to form transferable images. Each image is transferred sequentially to a respective receiver member whereby each image forms one of the several color separations for the multicolor reproduction. The sequential image transfer must be accomplished with high accuracy in order to obtain quality output of separations for faithful multicolor reproduction. In such color applications, transferable images generated from such successive "master" separations must be properly aligned for accurate superimposed registration during the creation of a multicolor composite print.

Therefore, during the production of such a separation, lateral movement of the belt during belt rotation must be closely controlled.

Ideally, if the photoreceptor belt was perfectly constructed and entrained about perfectly cylindrical rollers mounted and secured in an exactly parallel relationship with one another, the velocity vector of the belt would be substantially normal to the longitudinal axis of the roller and there would be no lateral walking of the belt. However, in actual practice, this is not feasible. Frequently, the velocity vector of the belt approaches the longitudinal axis or axis of rotation of the roller at an angle. This produces lateral movement of the belt relative to the roller. Alternatively, the axis of rotation of the roller may be tilted relative to the velocity vector of the belt. Under these circumstances, the belt will also move laterally. Thus, the belt must be tracked or controlled to regulate its lateral position.

Numerous methods of controlling the lateral movement of the photoreceptor belt maintain the belt within desired parameters have been proposed and implemented. Certain of these control schemes use a characteristic steering coefficient when determining proper correction procedures. Generally, the characteristic steering coefficient is calculated for a prototype machine and this calculated coefficient is then transferred or used in a fixed manner by later manufactured machines. However, each manufactured machine will be different from any other machine, therefore the calculated steering coefficient of the prototype will not be ideally suited for each machine. Additionally, over time and/or when machine is serviced, characteristics of the machine will change. Thus, the use of a fixed characteristic steering coefficient will increase inaccuracies in the belt control scheme.

Accordingly, it is an object of the present invention to improve the system controlling the lateral movement of the photoreceptor belt employed in an electrophotographic printing machine including a method for repeatedly updating the steering coefficient.

SUMMARY OF THE INVENTION

Briefly stated, and in accordance with the present invention, there is provided an apparatus and method for improving the control over lateral alignment of a belt arranged to move in a predetermined path.

Pursuant to the features of the present invention, the apparatus includes a roll arranged to support a portion of the belt passing thereover and a means for rotatably supporting the roll. A motor is connected to the means which rotatably supports the roll and is used for orienting a roll in a desired direction. A further means is provided for automatically controlling operation of the motor in order to center the belt on the roll. To improve the control of the lateral alignment of the belt, a method used in cooperation with the apparatus is provided for determining an updated steering control gain or coefficient used to control motor operation used for adjusting the steering roll.

One advantage of the present invention is the provision of a new and improved electrophotographic or electrostatographic printing machine.

Another advantage of the present invention is the provision of an improved means for controlling the lateral movement of a moving belt in an electrophotographic printing machine.

Still another advantage of the present invention is the provision of a means for determining a photoreceptor belt steering coefficient during system initialization for a printing machine. This initializes system steering data for each particular machine during initial machine setup.

Yet, another advantage of the present invention is the provision of a means for periodic calibration of a photoreceptor belt steering coefficient for each printing machine. Therefore, even if the characteristics of components of a belt module of a particular machine change due to the duty of that machine which then changes the steering rate such periodic calibration will capture steering data and provide a more accurate steering coefficient for that particular machine.

A further advantage of the present invention is the provision of a process for determining a photoreceptor belt steering coefficient for a particular machine, both for system initialization and for periodic recalibration.

Still other benefits and advantages of the invention will become apparent to those skilled in the art upon a reading and understanding of the following detailed specification.

BRIEF DESCRIPTION OF THE DRAWINGS

Other objects and advantages of the present invention will become apparent upon reading the following detailed description and upon reference to the drawings, in which.

DETAILED DESCRIPTION OF THE PREFERRED EMBODIMENTS

Figure 1:
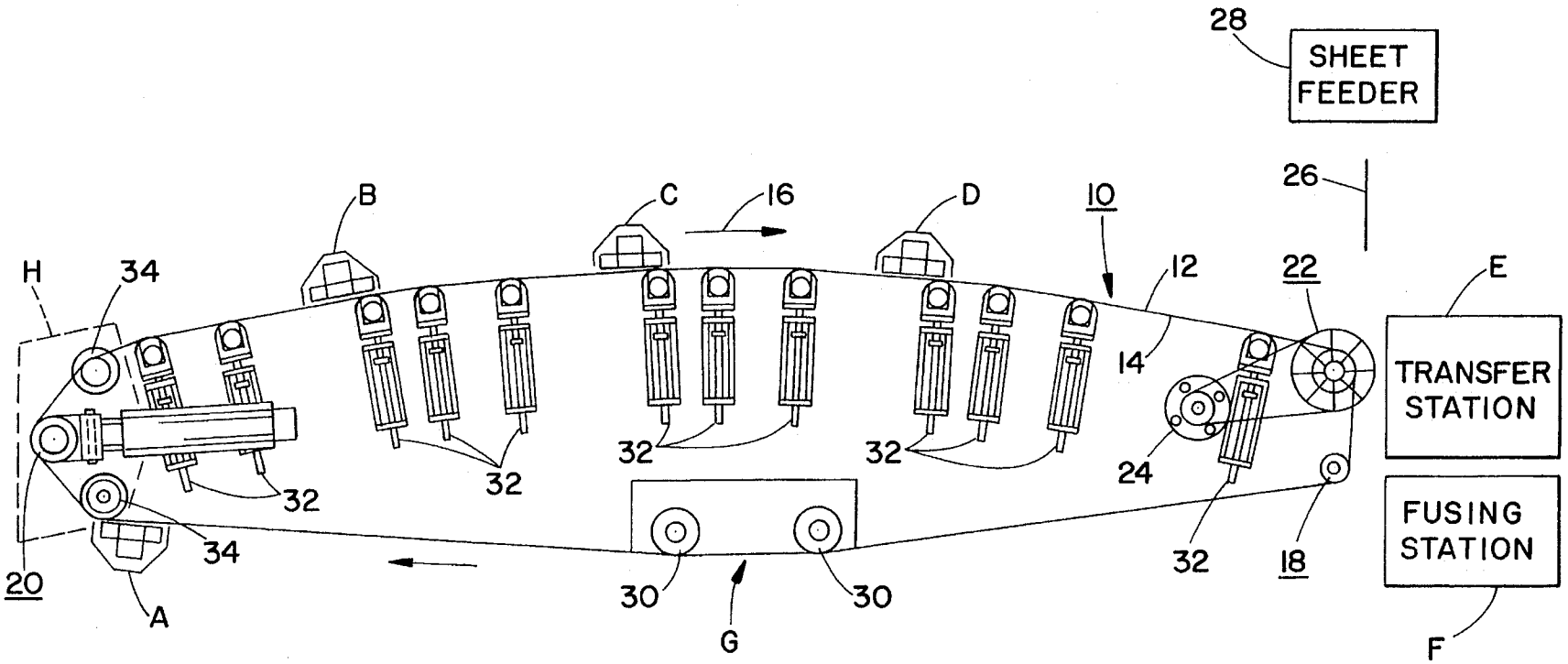
FIG. 1 is a schematic elevational view depicting a belt module of a single pass high light printing machine incorporating the features of the present invention.

For a general understanding of the illustrative electrophotographic printing machine incorporating the features of the present invention therein, reference is had to the drawings. In the drawings, like reference numerals have been used throughout to designate identical elements. FIG. 1 schematically depicts various components of an electrophotographic printing machine employing the belt support and steering mechanism of the present invention therein. Although the belt steering and support mechanism is particularly well adapted for use in an electrophotographic printing machine, it will become evident from the following discussion that it is equally well suited for use in a wide variety of office machines and other devices which employ a moving belt where the lateral movement of the belt needs to be controlled, and is not necessarily limited in its application to the particular embodiment shown herein.

FIG. 1 discloses a single pass high light color printing machine. The printing machine employs a belt 10 having a photoreceptor surface 12 deposited on a conductive substrate 14. Preferably, photoreceptor surface 12 can be made from a selenium alloy with conductive substrate being made from an aluminum alloy. Belt 10 moves in the direction of arrow 16 to advance successive portions of photoreceptor surface 12 sequentially through the various processing stations disposed about the path of movement thereof. Belt 10 is entrained about stripper roll steering/tension roll 20, and drive roll Steering/tension roll 20 is resiliently mounted. Belt end guides or flanges are positioned on opposed sides thereof and define a passageway through which belt 10 passes. Drive roll 22 is in engagement with belt 10 and advances belt 10 in the direction of arrow 16. Drive roll 22 is rotated by motor 24 coupled thereto by suitable means, such as a belt.

A blower system can be connected to stripper roll be and steering/tension roll 20. If desired, both stripper roll be and steering/tension roll 2 can have small holes in the circumferential surface thereof coupled to an interior chamber. The blower system furnishes pressurized fluid, i.e. a compressible gas such as air, into the interior chamber. The fluid egresses from the interior chamber through the apertures to form a fluid film between belt 10 and the respective roll, i.e. stripper roll 18 and steering/tension roll 20. In this manner, the fluid film at least partially supports the belt as it passes over the respective roll diminishing friction therebetween.

With continued reference to FIG. 1, stations A, B, C, and D are constructed to sequentially produce red, blue, green, and black images respectively. Each station A, B, C, and D separately charges, exposes, and develops images on belt 10. In the charging procedure, the photoreceptor surface 12 of belt 10 is charged to a relatively high, substantially uniform potential. Next, a digital image of the original document being copied, is exposed on belt 10 through an LED image bar. The LED image bar is part of each of the stations. The charged photoreceptor surface 12 is selectively discharged by the light image of the original document. This records an electrostatic latent image on photoreceptor surface 12 which corresponds to selected informational areas contained within the original document.

Thereafter, during the development procedure, the developer mix of the particular station is brought into contact with the latent image recorded on photoreceptor surface 12 of belt 10. The developer mix comprises carrier granules having toner particles adhering triboelectrically to the selected informational areas. The latent image attracts the toner particles from the carrier granules forming a toner powder image on photoreceptor surface 12 of belt 10.

The toner powder images recorded by the stations A, B, C, and D on photoreceptor surface 2 of belt 0 are then transported to transfer station E. At transfer station E, a sheet of support material 26 is positioned in contact with the toner powder images deposited on photoreceptor surface 2. The sheet of support material is advanced to the transfer station by a sheet feeding apparatus 28. Preferably, the sheet feeding apparatus 28 includes a feed roll contacting the uppermost sheet of a stack of sheets of support material. The feed roll rotates so as to advance the uppermost sheet from the stack. The sheet of support material 26 is moved into contact with the photoreceptor surface 12 of belt 10 in a timed sequence so that the developed powder images contact the sheet of support material at transfer station E. Transfer station E includes a corona generating device which applies a spray of ions to the backside of sheet 26. This attracts the toner powder image from photoreceptor surface 2 to sheet 26. After transfer, the sheet continues to move in the direction of arrow 6 and is separated from belt 10 by neutralizing the charge causing sheet 26 to adhere to belt 10. The sheet is advanced from belt 10 to a fusing station F which permanently affixes the transferred toner powder image to sheet 26. In this manner, the toner powder image is permanently affixed to sheet 26. After fusing, the sheet 26 is advanced for removal from the printing machine.

Invariably, after the sheet of support material is separated from photoreceptor surface 2 of belt 10, some residual particles remain adhering thereto. These residual particles are removed from photoreceptor surface 12 at cleaning station G. Cleaning station G includes rotatably mounted fibrous cleaner rolls/brushes 30 in contact with photoreceptor surface 12 of belt 10. The particles are cleaned from photoreceptor surface 12 by the rotation of cleaner rolls/brushes 30 in contact therewith. Subsequent to cleaning, a discharge lamp floods photoreceptor surface 12 with light to dissipate any residual electrostatic charge remaining thereon prior to the charging thereof for next successive imaging cycle. Support rolls 32 and isolation rolls 34 are included to provide support of the belt 10 throughout its length.

It is believed that the foregoing description is sufficient for purposes of the present application to illustrate the general operation of an electrophotographic printing machine.

Figure 2A:
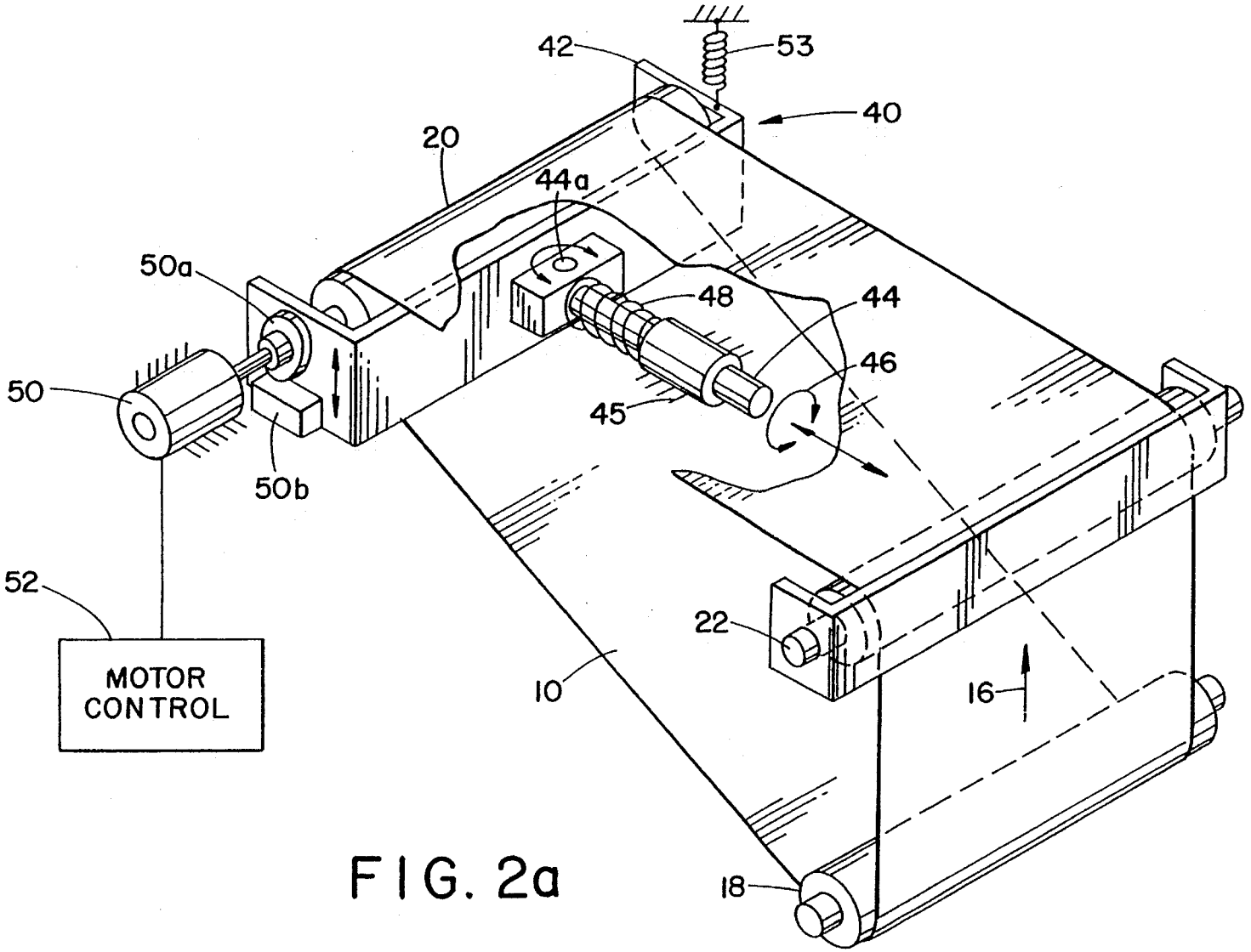
FIG. 2*a* is a schematic perspective view showing a belt module emphasizing the steering/tension roll and associated motor control and motor used in the printing machine of FIG. 1.

Referring now to the specific subject matter of the present invention, FIG. 2*a* depicts a structure for maintaining belt 10 substantially in lateral alignment during the movement thereof in the direction of arrow including structure which makes it possible to obtain and implement updated steering coefficients.

Steering/tension roll 2 is supported pivotably in yoke 4. Yoke 4 includes a U-shaped member 42 having steering/tension roll 20 mounted fixedly therein. A rod 44, having pin joint 44*a*, extends from the center of U-shaped member 42 and is mounted rotatably in a fixed frame. Preferably, rod 44 is supported in a suitable bearing 45 minimizing friction during the pivoting thereof. The longitudinal or steering axis of rod 44 is substantially normal to the longitudinal axis of roll 20. In this manner, roll 2 pivots in the direction of arrow 46 about the axis of rotation of rod 44. This steering axis of rotation controls the lateral displacement of the belt. Preferably, a tension spring 48 or the like resiliently biases or pushes the steering/tension roll 20 away from the stripper roll 8 and drive roll 22 to maintain a tension on the belt .

Steering motor 50 is attached to steering/tension roll 20. The steering motor may be a stepping motor or other suitable steering motor. Motor 50 has a cam 50*a*, preferably a linear cam, mounted on the motor shaft, with the cam bearing on block 50*b* which is positioned as part of yoke 40. Rotation of the motor causes the yoke to pivot in a desired manner through the cam, block arrangement. Controlled motor operation is accomplished by motor controller 52. A restraining spring 54 biases the steering/tension roll 2 to counteract the camming action from the opposite end.

Figure 2B:
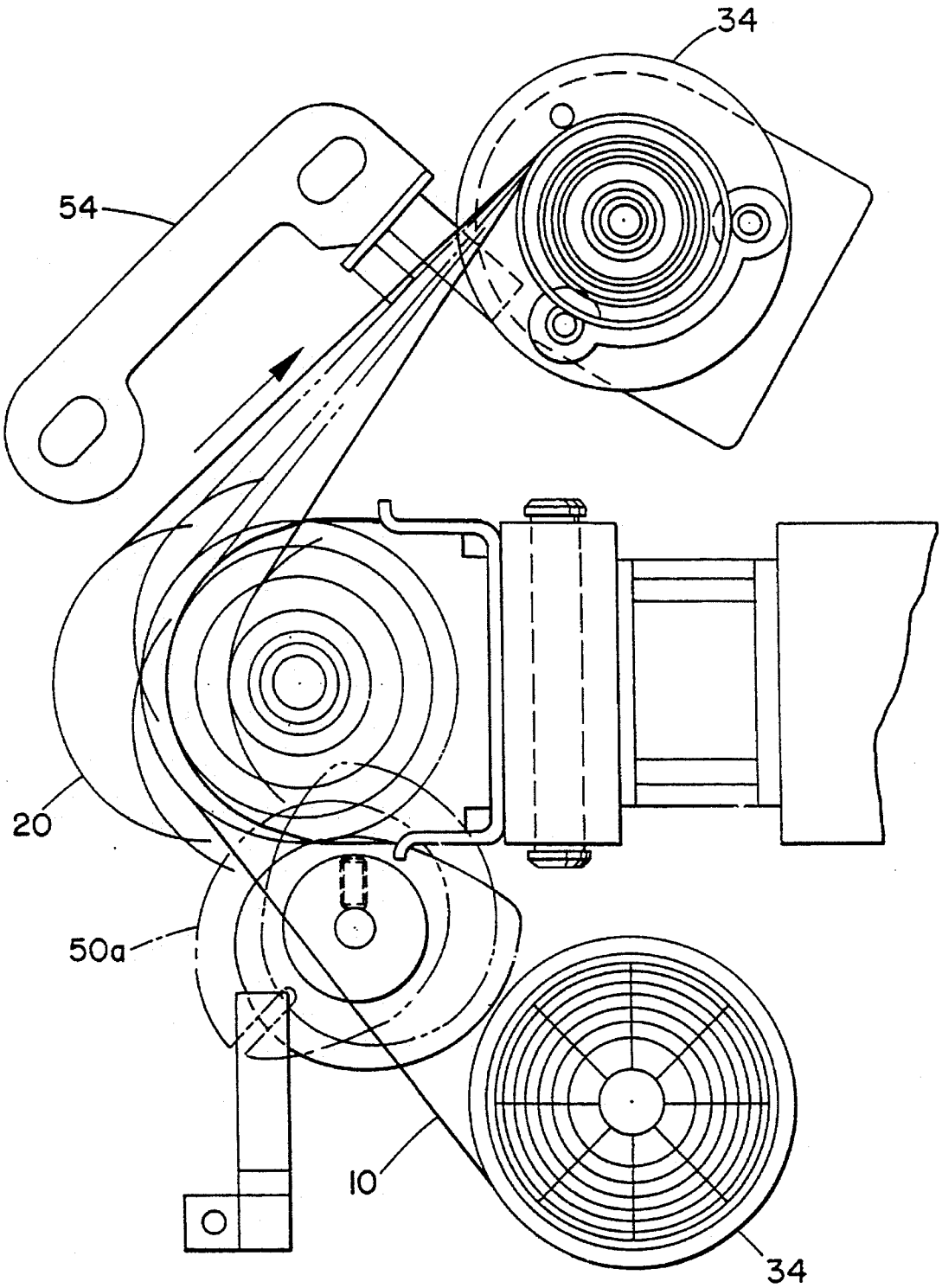
FIG. 2*b* is a side schematic view emphasizing section H of FIG. 1.

FIG. 2*b* provides a more detailed view of section H of FIG. 1 showing locations of the steering/tension roll 20, cam 50*a*, isolation rolls 34, belt 10, and a sensor 54. As can be seen in this Figure, movement of steering/tension roll 20 causes the angle of belt 10, between the isolation rolls 34 and the steering/tension roll 20, to be altered. The Figure discloses the steering/tension roll and cam at their nominal positions, and extended or rotated positions.

Figure 3:
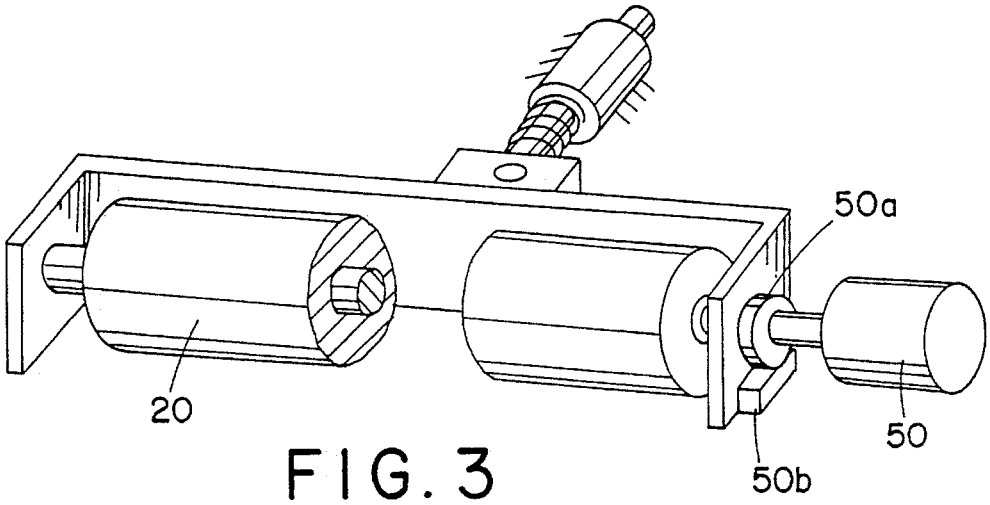
FIG. 3 is a perspective view, partially broken-away of the steering/tension roll assembly.

FIG. 3 shows the yoke arrangement of FIG. 2*a* in a cut-away view, having the belt omitted for improved clarity. It is to be noted that the motor may include a gear train and there may be other mechanical linkage between the cam and yoke.

Figure 4:
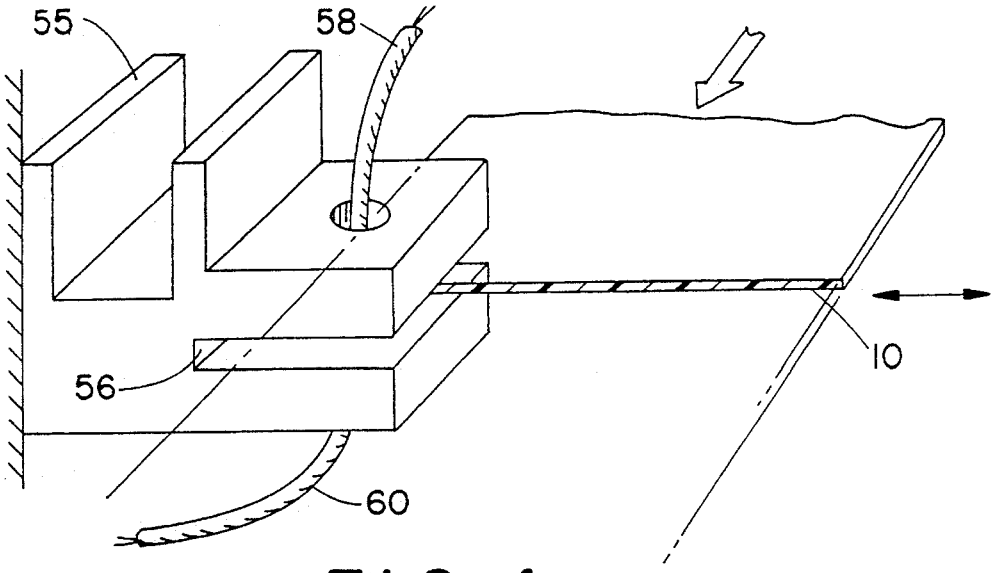
FIG. 4 is a perspective view of a belt edge sensor.
Figure 5:
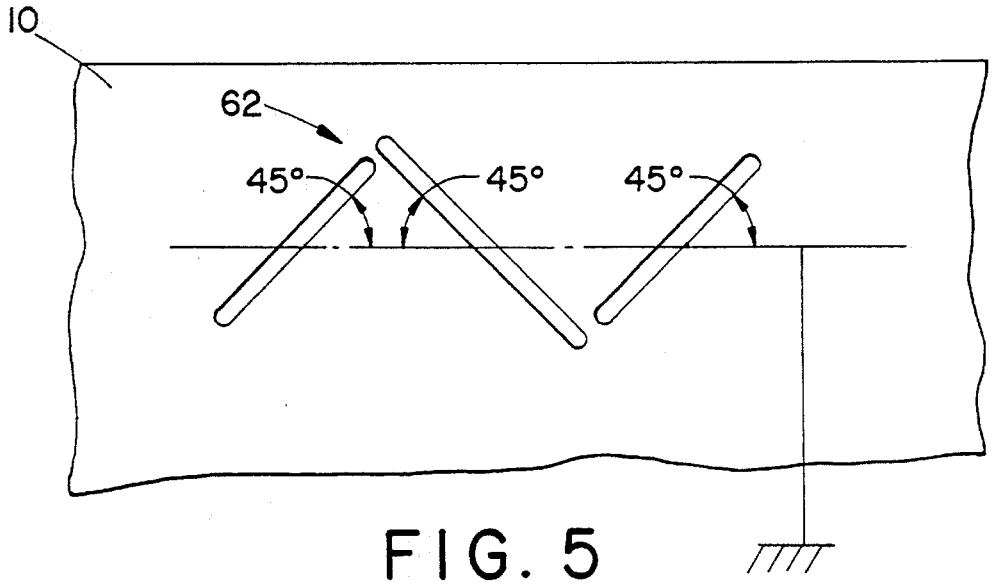
FIG. 5 is a top plan view of a belt edge incorporating therein a "Z" sensor slot arrangement.

FIGS. 4 and 5 disclose a manner of sensing belt movement in a preferred embodiment. A belt edge sensor 54 is positioned in the printing device to have the belt 10 pass through a slot opening 56. Illumination light (e.g. LED) from wires 58 illuminates the slot 56 in a desired manner. Analog lateral position signal wires 60 from a detector (not shown) are positioned on the underside of slot 56. As the belt 10 passes through slot 56, light is partially blocked and this information is transmitted from analog lateral position signal wires 60 to the detector element (not shown). The output analog voltage sensed by detector (not shown) is proportional to belt lateral position from a predetermined reference. The analog signal is subsequently conditioned, digitized, and sent to further control circuitry for adjustment of the belt position. In one embodiment, the control circuitry would be in the motor controller 52. In other embodiments, it could be sent to a control computer (not shown).

FIG. 5 shows a detailed view of a diagonal line target on the belt 10. This diagonal line target is in the form of a "Z-hole" pattern 62. As the "Z-hole" pattern on the belt moves with the belt under the belt edge sensor 54, the sensor traces a path across it. Using the "Z-hole" pattern, the belt position can accurately be determined. It is to be appreciated that other line target patterns such as a "N-hole" pattern can be implemented.

The "Z-hole" pattern sensor is the subject of a co-pending patent application entitled "Method and Apparatus for Transverse Image Registration on Photoreceptor Belts." This application was filed as Ser. No. 07/635,835 on Jan. 3, 1991, which has been allowed and the subject matter of this application is incorporated herein by reference.

Figure 6:
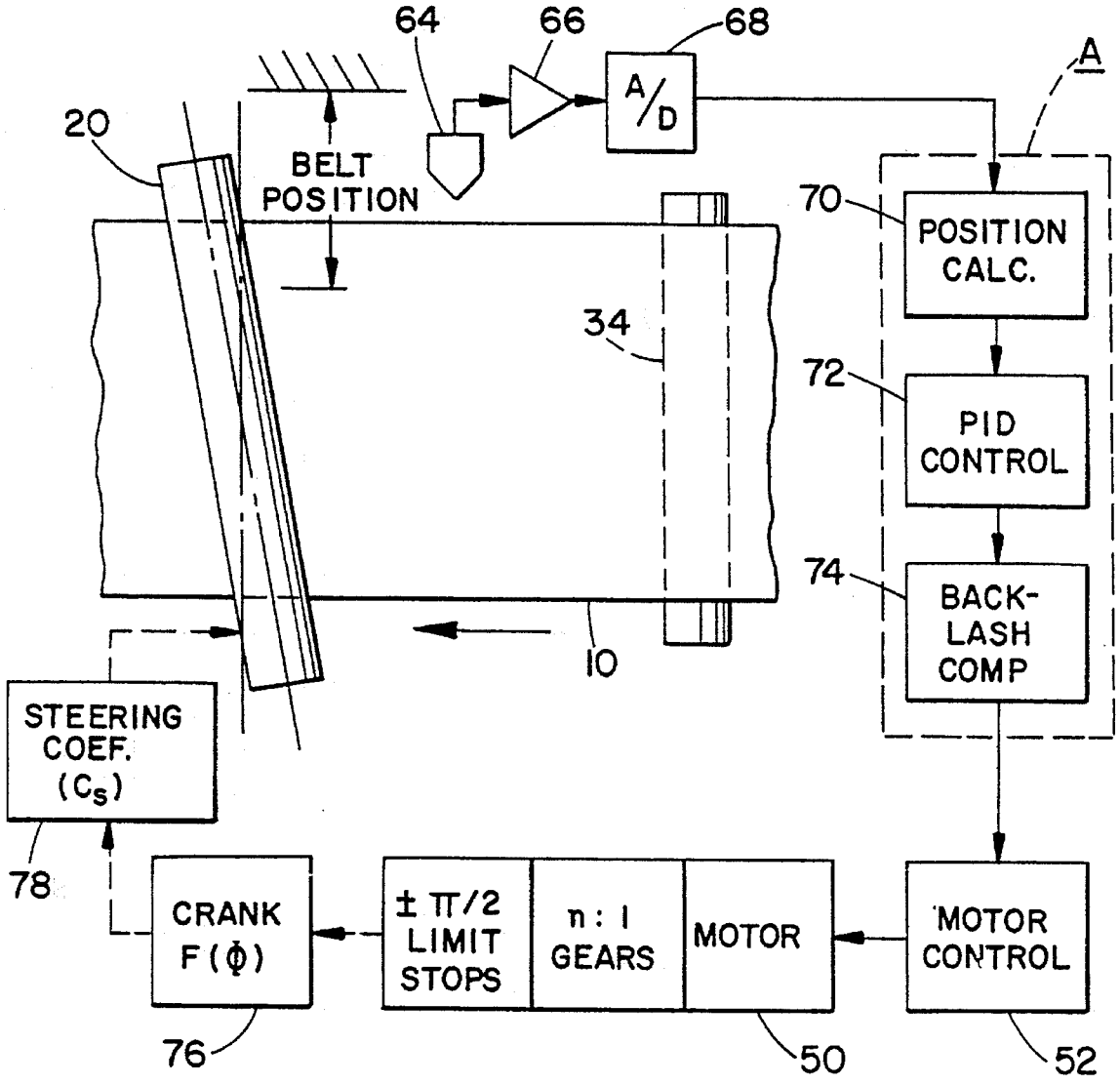
FIG. 6 is an active belt steering system block diagram.

The detection scheme shown in FIGS. 4 and 5 can be implemented in an active belt steering arrangement as shown generally in FIG. 6. The system includes a belt 10, steering/tension roll 20, and isolation rolls 34 and structure to support the rolls and belt. Lateral position sensing may be accomplished using a Z-hole sensor 62, or as shown in FIG. 6, by an arrangement including a belt edge sensor 64, a signal amplifier 66, and an A-D converter 68. In an automatic steering mode A, using an edge sensor, a position calculation block 70 receives the sampled data from the A-D converter to calculate the belt position. A Proportional Integral Derivative control (PID) 72 implements the position data obtained from the sampled data of the sensor to provide control signals for compensating undesirable belt movement. A backlash compensation circuit 74 is provided within the automatic steering mode A to reduce undesirable backlash in the movements of the belt and motor. The motor control 52 provides the developed correction signals from the Proportional Integral Derivative (PID) control 72 and supplies these signals to the motor 50. If desired, a known double eccentric steering roll crank 76 can be implemented, similar to the cam block arrangement shown in FIG. 2, in conjunction with the motor 50 to move the steering roll 20 in an appropriate position. A steering coefficient 78 is used in providing the proper movement compensation necessary in the system.

A characteristic steering coefficient of printing machines and other machines using a moving belt arrangement cannot be reliably predicted by calculation. Additionally, the coefficient is known to be sensitive to small deformations of the machine structure, such as may occur when the belt subassembly is pulled out for service and then replaced. Changes in the coefficient may also occur as the dimensions of particular belts 10 will vary. Prior to the present invention, the characteristic steering coefficient for a printing machine had been experimentally deduced on prototypes and that value was then projected to the entire population of subsequently produced machines. Therefore, it has been previously only possible to gain a general approximation of the actual value for any particular machine. This procedure compromises the accuracy and stability of the entire steering control system.

The present invention provides the capability of repeatedly measuring the steering coefficient while the belt is in place, even after machines have been sent to final work sites, and after belts have been changed.

Figure 8:
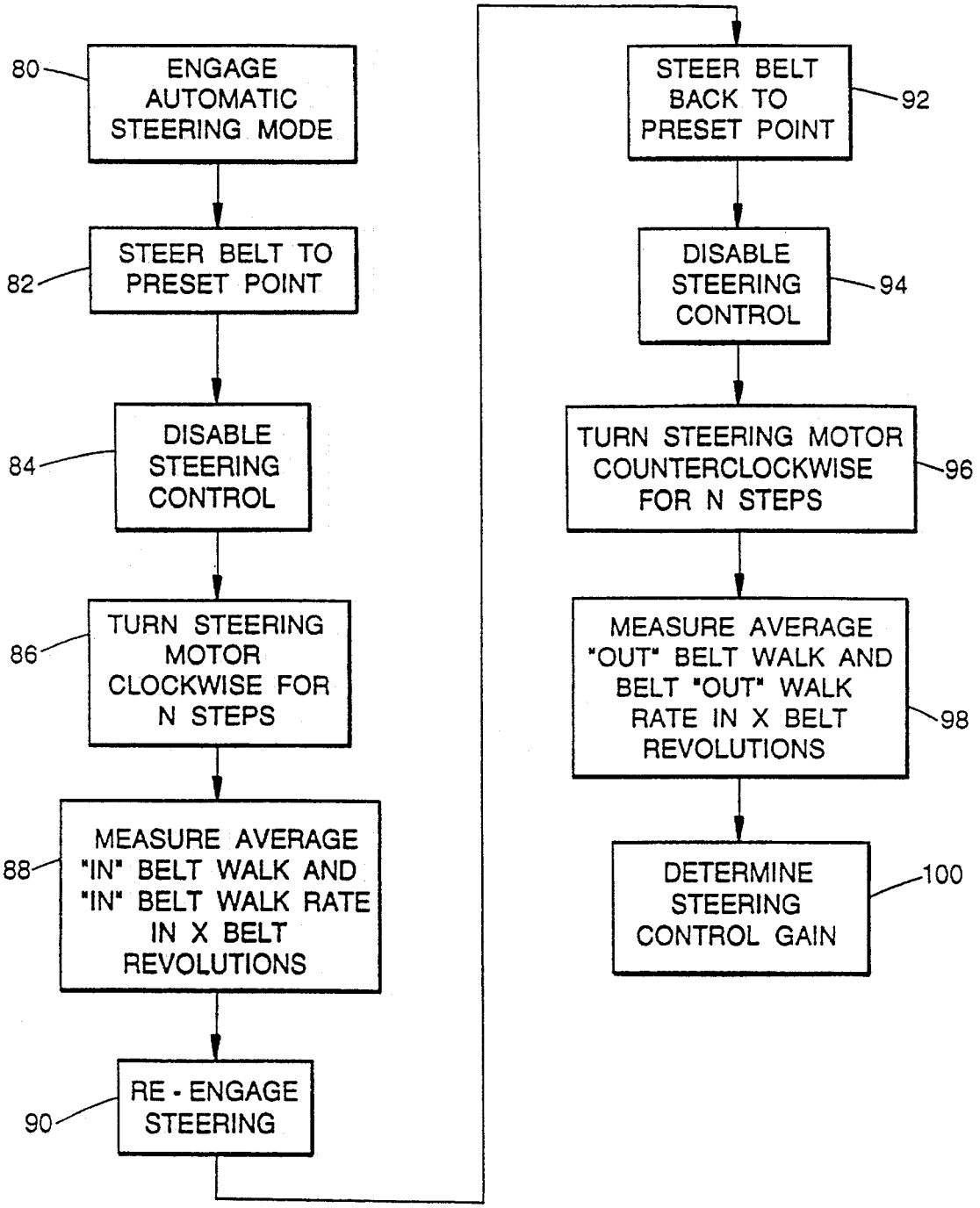
FIG. 8 is a flowchart showing the procedure for updating the steering coefficient; and, FIG. 9 is a graphical representation of results for a procedure used to obtain a steering coefficient calculation according to the present invention.

FIG. 8 provides a flowchart for updating a steering coefficient. The operations represented by the flowchart may be controlled by the motor control 52 or by a system computer (not shown). Initially, as shown in block 80, the automatic steering mode A is engaged in order to steer the belt to a preset point 82. When the belt is at the preset point, the automatic steering mode control is disabled 84. The steering motor 50 is then turned clockwise for a predetermined amount of steps 86 and the average belt walk (Yin) and the belt walk rate (dYin) in distance per belt revolution are measured for a predetermined number of belt revolutions 88, e.g., 4 revolutions (see FIG. 9). At this point, the automatic steering mode is re-engaged 90 and the belt is steered back to the preset point 92. The automatic steering control is again disabled 94 and the steering motor is turned counterclockwise for a predetermined amount of steps 96 and the average belt walk (Yout) and walk rate (dYout) are measured for a predetermined number of belt revolutions 98. It is to be appreciated that the determining of the "out" walk may be done prior to determining of the "in" walk Also, any desired number of belt revolutions can be used although the numbers should be identical Using the above-obtained data, an updated steering control gain or coefficient is determined 100.

Figure 9:
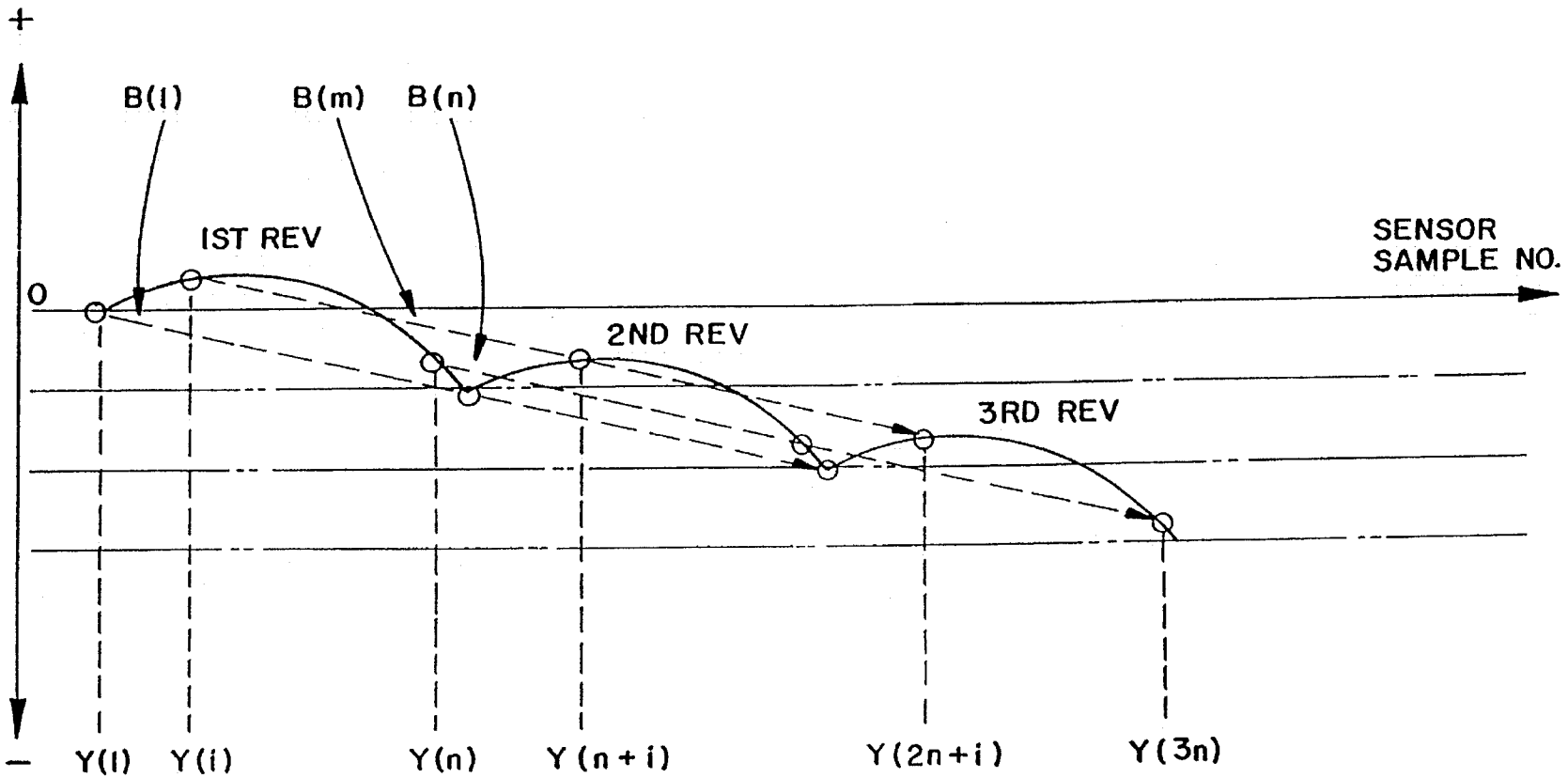

FIG. 9 provides a graphical representation of sensed edge data obtainable while the belt is drifting inward or outward. With continuing reference to FIG. 9, a procedure to determine the steering coefficient includes:

1. turning the steering roll to one side to remove possible backlash.
2. turning the steering roll in the same direction for N steps; lock the steering roll; run the belt for 3 revolutions; put belt edge data in an array Y(3n) at a fixed sample rate which is associated with a process encoder clock at n samples per belt revolution.
3. calculating the slope B(i), intercept A(i) of linear regression for each of n data sets consisting of Y(i), Y(n+i), Y(2n+i); find the belt walk rate (distance per revolution per N steering steps) by taking average of n slope data where:

$$Y_{in}=(\Sigma B(i))\div n$$

4. calculating a correlation coefficient CC(i) for each set of Y(i), Y(n+i), Y(2n+i).
5. repeating steps 1 through 4 to find Yout.
6. average belt walk rate $C_{steer}$ (steering coefficient) can then be determined by taking the average of Yin and Yout where:

$$C_{steer}=(Yin+Yout)\div 2.$$

It is important to have the values of B(1) . . . B(m) . . . B(n) close. If any CC(i) is far from ±1, it is likely the steering system is not stable.

In an idealized two roll system, the steering coefficient based on a specific two roll model would be found by:

$$Csteer=0.2551\delta y\div\delta x$$

wherein

Csteer=Steering Coefficient (CS)

δy=average belt walk per belt revolution; (equal to ½(dYin+dYout)) assuming the walk rate is approximately the same near the set point; and, δx=the calculated yoke end displacement due to the number of steering steps.

Upon obtaining the updated coefficient of steering, the machine can then be switched back to the automatic steering control mode using the new coefficient. The obtained steering coefficient is then used in a known control scheme for subsequent belt steering control. By implementing this method, a greater degree of accuracy is obtained in controlling belt movement.

It is to be appreciated that although the present application suggests updating the steering coefficient in a machine using a PID control scheme, the updating of the steering coefficient can be implemented in other control schemes including Proportional+Derivative (P+D) or lead-lag series filtered control.

Figure 7:
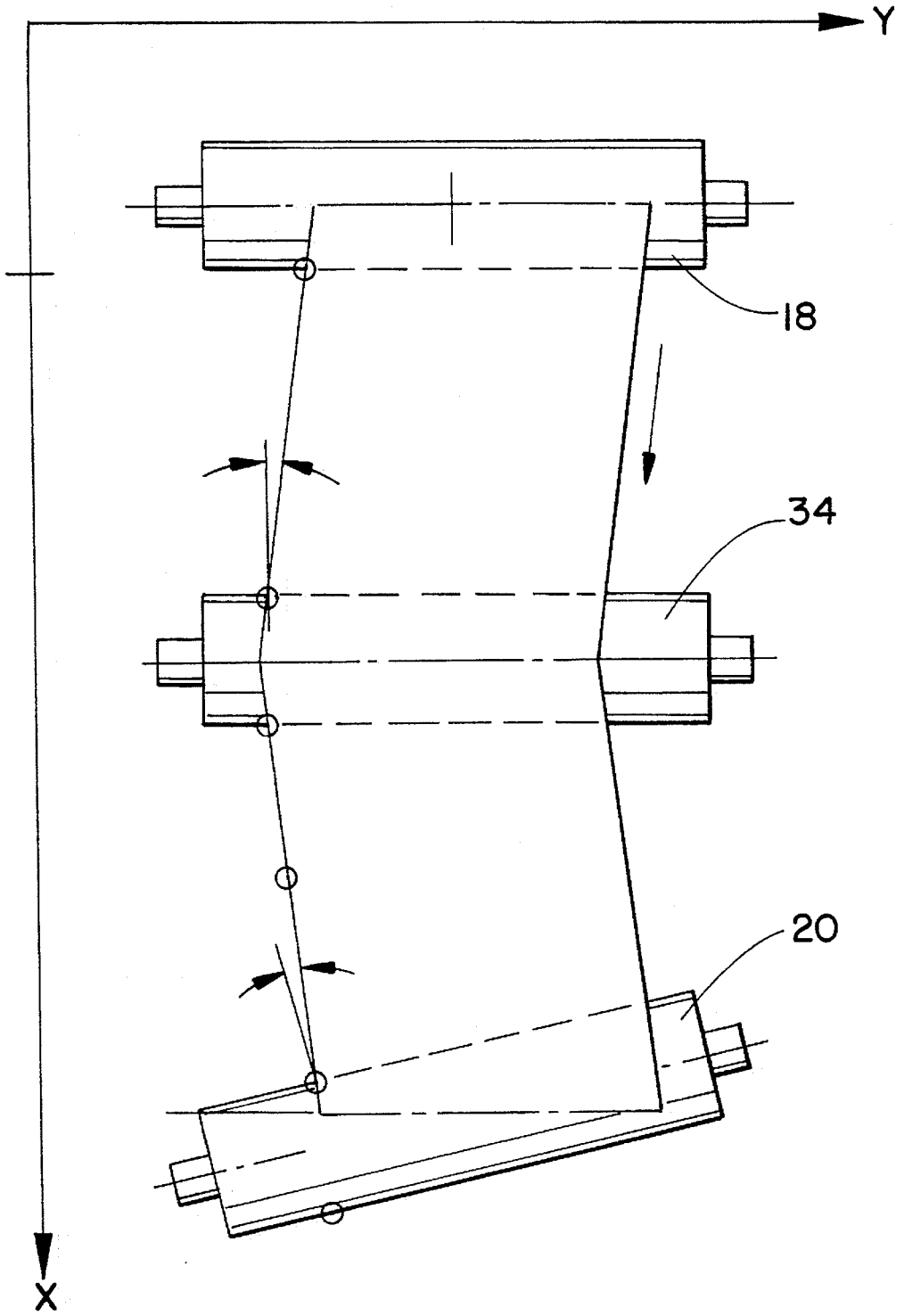
FIG. 7 is a developed view of three rolls.

FIG. 7 shows a top view of a three roll system with the steering roll 20 being adjusted to compensate for belt movement.

From the above-discussion, it is evident that there has been provided in accordance with the present invention, an apparatus and method for improving the control over compensation for lateral movement of a photoreceptor belt such that the belt moves in a predetermined path. This apparatus fully satisfies the objects, aims, and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications, and variations as fall within the spirit and broad scope of the appended claims.

What is claimed:

1. An apparatus for controlling lateral alignment of a belt arranged to move in a predetermined path, the apparatus comprising:

a roll arranged to support a portion of the belt passing thereover;

a pivotable means for rotatably supporting said roll;

a motor, connected to said pivotable means such that operation of said motor alters an orientation of the roll by pivoting said pivotable means in a desired direction;

a means for automatically controlling operation of said motor in order to maintain the belt on said roll within preset position parameters, said means for automatically controlling including, a belt edge detector for acquiring belt tracking data, and a motor controller for actuating and controlling said motor based on the belt tracking data acquired; and a means for initializing said automatically controlling means said means for initializing including, a means for determining a tilt range of said roll, a means for determining a linear displacement of an end of said pivotable means, and a means for determining a number of revolutions of said roll.

2. The apparatus of claim 1 wherein said means for initializing further comprises:

a means for steering said motor clockwise for N steps;

a means for steering said motor counterclockwise for N steps; and, a means for setting a steering coefficient of said motor.

3. The apparatus of claim 1 further comprising a drive roll for rotating the belt.

4. An apparatus for controlling lateral alignment of a belt arranged to move in a predetermined path, the apparatus comprising:

a roll arranged to support a portion of the belt passing thereover;

a pivotable means for rotatably supporting said roll, said pivotable means including, a yoke on which said roll is rotatably mounted, a spindle to which said yoke is secured, and a frame on which said spindle is mounted;

a motor, connected to said pivotable means such that operation of said motor alters an orientation of the roll by pivoting said pivotable means in a desired direction;

a means for automatically controlling operation of said motor in order to maintain the belt on said roll within preset position parameters, said means for automatically controlling including, a belt edge detector for acquiring belt tracking data, and a motor controller for actuating and controlling said motor based on the belt tracking data acquired;

a means for initializing said automatically controlling means; and a means for manually pivoting said yoke.

5. An apparatus for controlling operations upon a belt, comprising:

a means for sensing an edge pattern of said belt, said edge pattern comprising a cross-track position and an in-track position of said belt;

a means for generating signals representing sensed edge pattern data;

a means for storing said edge pattern data;

a means for comparing said sensed edge pattern data; and, a means for steering said belt to a desired edge position from several belt revolutions when the sensed edge position exceeds a pre-determined allowed limit value.

6. The apparatus of claim 5 wherein said means for steering comprises:

a roll arranged to support a portion of said belt passing thereover;

a means for rotatably supporting said roll; and, a motor, connected to said means for rotatably supporting said roll, for orienting said roll in a desired direction.

7. The apparatus of claim 6 wherein said means for rotatably supporting said roll comprises:

a yoke on which said roll is rotatably mounted;

a spindle to which said yoke is secured; and, a frame on which said spindle is mounted.

8. The apparatus of claim 5 wherein said means for sensing said edge pattern comprises a belt edge detector.

9. The apparatus of claim 5 wherein said means for comparing comprises a computer.

10. An electrophotographic printing machine of a type having an endless photoreceptor belt arranged to move in a predetermined path through a plurality of processing stations disposed therealong, the machine comprising:

a roll arranged to support a portion of the endless photoreceptor belt passing thereover;

a yoke on which said roll is rotatably mounted;

a spindle to which said yoke is secured;

a cam secured to an end of said yoke;

a cam follower in operative engagement with said cam;

a motor, connected to said cam follower, for operating on said cam and pivoting said yoke on said spindle and hence orienting said roll in a desired direction;

a means for automatically controlling operation of said motor in order to center the belt on said roll;

said means for automatically controlling including, a belt edge detector for acquiring belt tracking data, a steering motor controller for actuating and controlling said motor based on the belt tracking data acquired, and a means for initializing said automatically controlling means;

a means for initializing said automatically controlling means, said means for initializing including, a means for determining a tilt range of said roll;

a means for determining a linear displacement of an end of said yoke, and a means for determining a number of revolutions of said roll.

11. The machine of claim 10 further comprising a drive roll for rotating the belt.

12. The machine of claim 10 wherein said means for initializing further comprises:

a means for steering said motor clockwise for N steps;

a means for steering said motor counterclockwise for N steps; and, a means for setting a steering coefficient of said motor.

13. The apparatus of claim 10 further comprising a frame on which said spindle is mounted.

14. The apparatus of claim 10 further comprising a means for manually pivoting said yoke.

15. A method for initializing a steering control of a belt moving along a path by operation of a motor, the belt being subject to lateral movement in a direction transverse to a direction of movement of the belt along the path, the method comprising the steps of:

steering the belt to a preset position;

turning the motor clockwise for N steps;

measuring an average belt walk and rate of belt walk for X belt revolutions;

steering the belt back to the preset position; turning the motor counterclockwise for N steps;

measuring an average belt walk and rate of belt walk for X belt revolutions; and, determining a steering control gain.

16. The method of claim 15 further comprising the steps of:

engaging an automatic steering mode before said step of steering the belt to a preset position; and disabling the automatic steering mode before said step for turning the motor.

17. In an electrophotographic printing machine of a type having an endless photoreceptor belt arranged to move in a predetermined path through a plurality of processing stations disposed therealong, a method for automatically and repeatedly measuring and updating a steering coefficient used in an automatic steering mode employing a steering motor, to maintain the endless photoreceptor belt within predetermined parameters, the method comprising:

engaging the automatic steering mode;

steering the belt to a preset position;

disengaging the automatic steering mode;

turning the steering motor clockwise for N steps;

measuring an average belt walk in and rate of belt walk in for X belt revolutions;

reengaging the automatic steering mode;

steering the belt back to the preset position;

disengaging the automatic steering mode;

turning the steering motor counterclockwise for N steps;

measuring an average belt walk out and rate of belt walk out for X belt revolutions; and, determining the steering coefficient.

18. The method of claim 17 wherein the steering coefficient is determined when the electrophotographic printing machine is powered.

19. The method of claim 17 wherein the automatic steering mode uses a control scheme of at least one of (i) lead-lag series control, (ii) proportional+derivative control, and (iii) proportional integral derivative control.

20. The method of claim 17 where the electrophotographic machine uses at least two rollers to move the belt, the step of determining the steering coefficient (Csteer) includes applying relationship, $$Csteer=0.2551\delta y\div\delta x$$

wherein

δy=average belt walk per belt revolution which is equal to ½(dYin+dYout), with dYin equal to an in-belt walk rate and dYout equal to an out-belt walk rate, and, δx=measured displacement of steering yoke end displacement for the number of steering steps and camming geometry.

21. In an electrophotographic printing machine of a type having an endless photoreceptor belt arranged to move in predetermined path through a plurality of processing stations disposed therealong, a method for automatically and repeatedly measuring and updating a steering coefficient used in an automatic steering mode employing a steering motor, to maintain the endless photoreceptor belt within predetermined parameters, the method comprising:

a) turning a steering roll to one side of the machine to remove possible backlash;

b) turning the steering roll in a predetermined direction for N steering steps;

c) locking the steering roll;

d) running the belt for x revolutions;

e) obtaining belt edge data from a belt edge detector during operation of step d;

f) storing the belt edge data in an array at a fixed sample rate which is associated with a process encoder clock at n samples per belt revolution;

g) calculating a slope B(i), intercept A(i) of linear regression for each of n data sets consisting of said Y(i), Y(n+i), Y(2n+i);

h) determining a belt walk rate defined as, distance per revolution per said N steering steps, by taking an average of n slope data where, $Y_{in}=(\Sigma B(i))\div n$;

i) calculating a correlation coefficient CC(i), which determines stability of the system, for each set of said Y(i), Y(n+i), Y(2n+i);

j) repeating steps a through i to find Yout in the same manner $Y_{in}$ was found; and, k) determining steering coefficient, $C_{steer}$, by taking an average of Yin and Your where, $C_{steer}=(Yin+Yout)\div 2$.

22. The apparatus of claim 4 further comprising a drive roll for rotating the belt.

23. In an electrophotographic printing machine of a type having an endless photoreceptor belt arranged to move in predetermined path through a plurality of processing stations disposed therealong, a method for automatically and repeatedly measuring and updating a steering coefficient used in an automatic steering mode employing a steering motor, to maintain the endless photoreceptor belt within predetermined parameters, the method comprising:

a) turning a steering roll, with clockwise rotation about its steering axis, to one side of the machine for a number of steering steps to remove possible backlash;

b) further turning the steering roll in the same direction for N steering steps;

c) locking the steering roll;

d) running the belt for x revolutions;

e) obtaining belt edge position data from a belt edge detector during operation of step d;

f) storing the belt edge position data in an array (Y(i), i=1, xn) at a fixed sample rate which is associated with a process encoder clock at n samples per belt revolution;

g) calculating a slope B(i), intercept A(i) of linear regression for each of n data sets consisting of said (Y(i), Y(n+i), . . . Y((x−1)n+i), i=1, n);

h) determining a belt walk rate defined as, distance per revolution per said N steering steps, by taking an average of n slope data where steering coefficient ($C_{cw}$), $C_{cw}=(\Sigma B(i))\div n$;

i) calculating a correlation coefficient CC(i), which determines stability of the system, for each of n belt edge position data sets of step g;

j) repeating steps a through i to find counter clockwise steering coefficient ($C_{ccw}$), in the same manner $C_{cw}$ was found, for the steering roll turning with counter clockwise rotation about its steering axis; and, k) determining $C_{cw}$ or $C_{ccw}$ depending on the direction of the steering rotation.

* * * * *